United States Patent [19]

Martin

[11] 4,325,459

[45] Apr. 20, 1982

[54] MUFFLER DIFFUSER

[76] Inventor: Mack M. Martin, 7212 Grand Blvd., Houston, Tex. 77054

[21] Appl. No.: 192,435

[22] Filed: Sep. 29, 1980

[51] Int. Cl.[3] ..... F01N 1/10

[52] U.S. Cl. ..... 181/248; 181/252

[58] Field of Search ..... 181/247, 248, 251, 252, 181/256, 222, 264, 267, 268

[56] References Cited

U.S. PATENT DOCUMENTS

| | | | |
|---|---|---|---|
| 1,924,605 | 8/1933 | Haas et al. | 181/247 |
| 1,991,748 | 2/1935 | Johnson | 181/247 |
| 3,196,977 | 7/1965 | Sanders | 181/256 |
| 4,109,753 | 8/1978 | Lyman | 181/252 |

*Primary Examiner*—L. T. Hix
*Assistant Examiner*—Benjamin R. Fuller
*Attorney, Agent, or Firm*—Pravel, Gambrell, Hewitt, Kirk, Kimball & Dodge

[57] ABSTRACT

An improved muffler diffuser adapted to be used with a muffler having a diffuser element mountable within the muffler adjacent the inlet end, with the diffuser element having a body portion mountable with the muffler and a diffuser portion disposed within the muffler being of a substantially truncated, conic configuration, with the diffuser portion extending downstream towards the exit end of the muffler and having a plurality of openings formed therein for directing the noisy, gaseous exhaust into the muffler to effectuate a reduction in noise and back pressure.

7 Claims, 4 Drawing Figures

MUFFLER DIFFUSER

TECHNICAL FIELD

The field of this invention relates to mufflers typically used on engines, pumps and/or power plants of all types for noise reduction, and more particularly to those devices having a structure for improved noise reduction and performance characteristics.

PRIOR ART

So far as known, mufflers have long been used for the reduction of noise levels attendant to power plant operation, be the power plant that of a vehicle such as a car or truck, a small power plant such as on a lawn mower, or large commercial power plants associated with portable and stationary power generative systems. It has long been known that by flowing noisy exhaust gases from such power plants through multiple chambers or through sound deadening materials, the noise produced by the operating power plant may be significantly reduced.

Typically, an operating power plant produces noise because of the explosions occuring in proximity to the piston-cylinder-head arrangement of a typical combustion engine during operations thereof. The explosions coupled with high fluid velocities of the hot exiting gas result in a noisy, exhaust gas that must be directed away from the operating power plant. It has been found that the manner in which the exhaust gases are directed from the operating power plant may be important to operation of the power plant, in that a failure to remove the exhaust gases as quickly as they are formed, results in a back pressure which is exerted on the operative elements of the power plant which tends to reduce performance of the power plant. Thus, it is desirable not only to reduce the noise levels of the exiting exhaust gases, but also to effectuate a reduction in back pressure to increase the overall efficiency of the power plant operation.

Various techniques are known in the prior art to increase performance. These include "tuning" the length of the exhaust pipe and/or muffler to conform with the typically sinusoidal noise pulse produced by the operating power plant which tends to reduce the back pressure of the noisy, gaseous exhaust. So far as known, no inexpensive, easily manufactured devices capable of improving the sound deadening qualities of the muffler while simultaneously improving overall performance of the power plant are available.

SUMMARY OF THE PRESENT INVENTION

The present invention relates to a new and improved muffler diffuser adapted to be used with the muffler with the diffuser including a diffuser element mounted within the muffler for effectively helping to reduce noise and back pressure attendant to power plant operation.

DESCRIPTION OF THE PREFERRED EMBODIMENT

Figure 1:
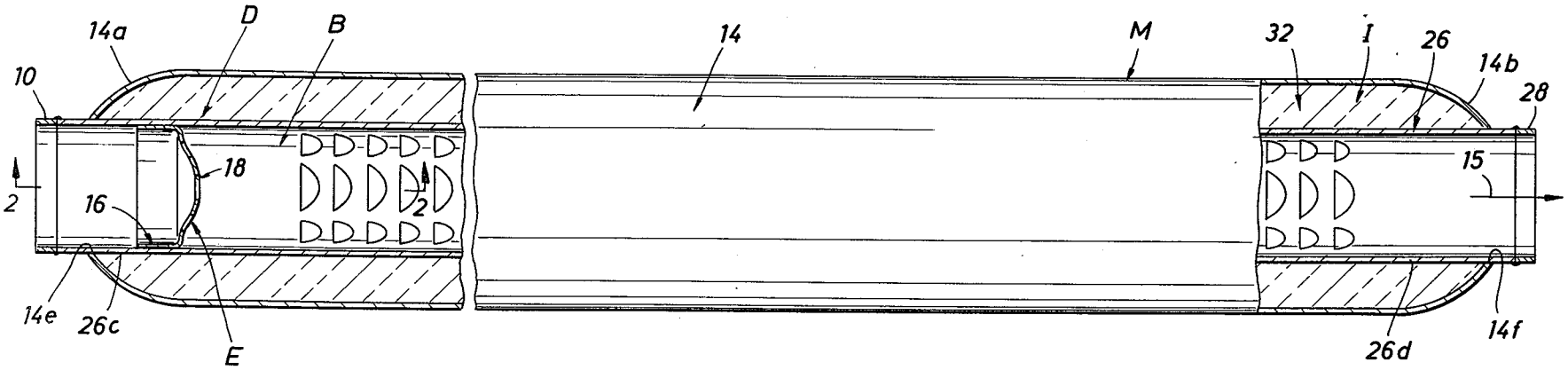
FIG. 1 is an elevational, partially sectional view of a muffler showing the muffler diffuser of the present invention.

In the drawings, the letter D designates generally muffler diffuser of the present invention. The muffler diffuser D is adapted to be used with a muffler M. The muffler M is typically mounted in flow communication with the exhaust gases exiting from a suitable power plant (not shown). The power plant may be of any type, ranging from a small 1-3 horsepower lawnmower engine to a 100-600 horsepower automobile-truck engine to a several thousand horsepower diesel that may be operated in a locomotive, stationary power plant or the like. Also, it should be appreciated that any type of sound generating phenomonen having an exhaust stream may use the muffler diffuser D with the muffler M of the present invention, which may include all types of pumping devices, compressing devices, and the like. All of such power plants typically involve, during their operative processing, the generation of noisy exhaust gases that need to be directed from the power plant. The exhaust gases are typically directed from an exhaust port of the power plant through an appropriate exhaust pipe 10 to the muffler M. As such, exhaust gases depart from the power plant, flow through the exhaust pipe 10 thereunto the muffler M in the direction of the arrow 12. Typically, such exhaust gases are entrained with high decibal noise levels caused by combustion, compression and/or pumping processes, and are consequently noisy.

The muffler diffuser D of the present invention is adapted to be used with the muffler M. The muffler M includes muffler housing 14 having an inlet end 14*a* for receiving the noisy, gaseous exhaust in the direction of arrow 12 and an exit end 14*b* for discharging the exhaust in a less noisy condition in the direction of arrow 15. The muffler housing 14 is formed preferably having an outer surface 14*c* and an inner surface 14*d*. As shown in FIG. 1, the muffler housing 14 is of a generally cylindrical configuration and such is preferred; however, any other configuration may be suitable. The muffler housing 14 is preferably formed having an inlet opening 14*e* formed adjacent the inlet end 14*a* and an exit opening 14*f* formed adjacent the exit end 14*b*, with openings 14*e*, 14*f* preferably being in alignment with one another, for the reasons set forth more fully hereinbelow.

The muffler diffuser D of the present invention includes generally a diffuser element E, a baffle B, and insulation means I. The diffuser element E of the muffler diffuser D is mountable within the muffler M adjacent the end 14*a*. The diffuser element E has a body portion 16 and a diffuser portion 18. The body portion 16 of the diffuser element E is preferably of a substantially tubular configuration and is adapted to be longitudinally mounted and aligned with the longitudinal axis of the muffler M and includes an outer annular surface 16*a*, an inner annular surface 16*b* and a radial end surface 16*c*. The diffuser portion 18 of the diffuser element E is preferably of a substantially truncated conical configuration and is adapted to be longitudinally aligned with the longitudinal axis of the muffler M. As such, the greatest diameter of the diffuser portion 18 is adjacent area 18*a* and the smallest diameter of the diffuser portion 18 is adjacent area 18*b*, with area 18*b* extending downstream of area 18*a*. Thus, area 18*a* is closer to the inlet end 14*a* of the muffler housing 14 while area 18*b* is downstream of area 18*a* and extends towards the exit end 14*b* of muffler housing 14.

Figure 2:
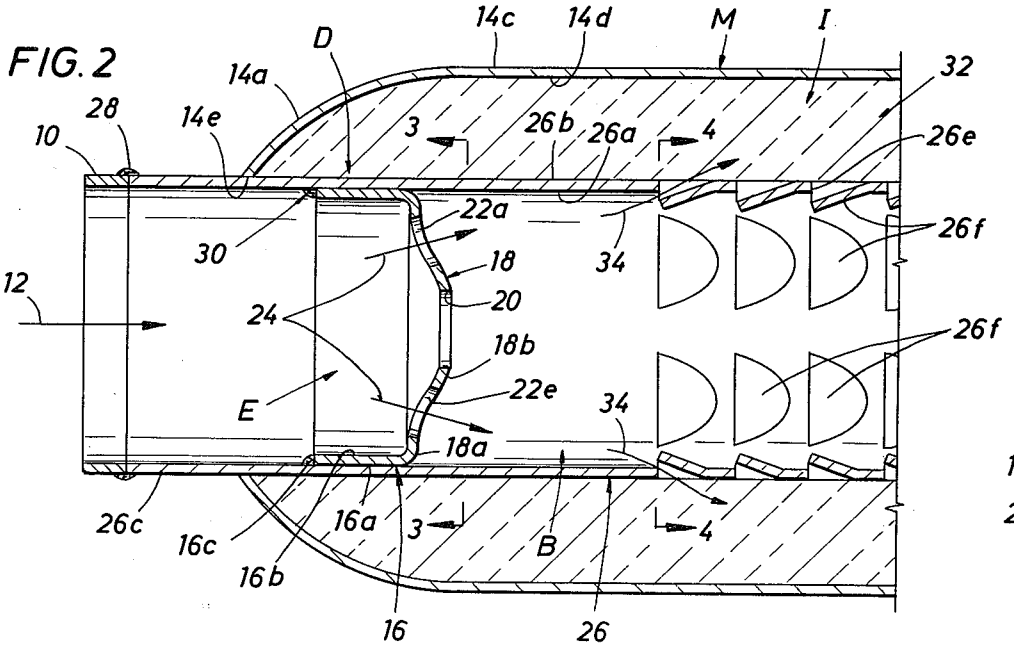
FIG. 2 is an enlarged, sectional view of the muffler diffuser of the present invention, as taken along the lines 2—2 of FIG. 1.
Figure 3:
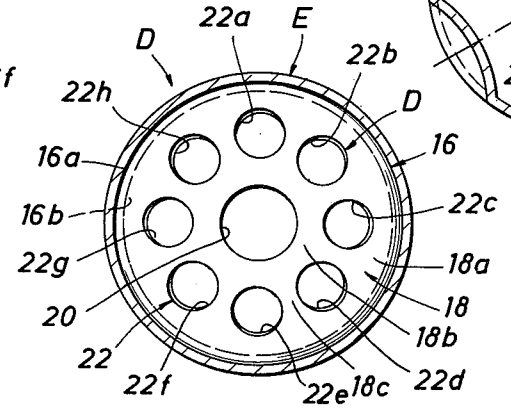
FIG. 3 is a sectional, end view of the diffuser element of the muffler diffuser of the present invention, as taken along the lines 3—3 of FIG. 2; and, FIG. 4 is a sectional, end view of the louvers formed in the baffle of the muffler diffuser of the present invention, taken along the lines 4—4 of FIG. 2.

As best seen in FIG. 3, the diffuser portion 18 is formed having a plurality of openings O formed therein for directing the noisy gaseous exhaust into the muffler M as discussed more fully hereinbelow. The openings O include a central opening 20 and a plurality of openings 22 radially disposed equidistance about the diffuser portion 18. Preferably, the openings 22 are formed with the diffuser portion 18 such that there are eight of such openings, namely 22*a*, 22*b*, 22*c*, 22*d*, 22*e*, 22*f*, 22*g*, 22*h*. As best seen in FIG. 2, the diffuser portion 18 preferably of a generally truncated conical configuration with the openings 22*a*–22*h* formed with the diffuser portion 18 such that they are formed with the conic sides 18*c* of the diffuser portion 18 between areas 18*a*, 18*b*. As such, the openings 22 are at an angle with respect to the longitudinal axis of the muffler M, with that angle being such as to direct the incoming exhaust gases entering the muffler M in the direction of arrow 12 and modify its direction of flow angularly, radially outwardly in the direction of arrow 24.

Figure 4:
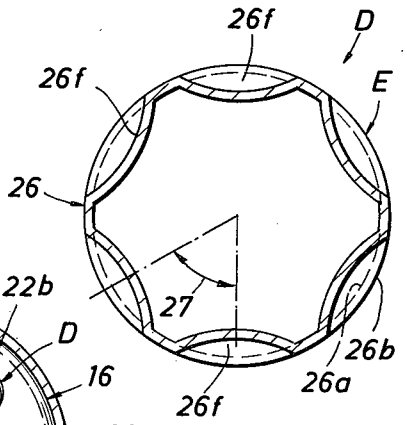

The muffler diffuser D of the present invention further includes a baffle B mountable within the muffler M. The baffle B is preferably of a substantially tubular configuration and includes baffle body member 26 which is preferably formed having an inner annular surface 26*a* and outer annular surface 26*b*. Inlet end 26*c* is preferably rigidly attached with the exhaust pipe 10 by an appropriate weldment 28 or the like, while the exit end 26*d* is securely mounted with tail pipe 28, with the tail pipe 28 receiving gases flowing in the direction of arrow 15. Preferably, the baffle B is adapted to be longitudinally aligned with the longitudinal axis of the muffler M and is formed such that the diffuser element E is mountable therewith. More particularly, the body portion 16 of the diffuser element E is sized such that the outer annular surface 16*a* of the body portion 16 abuts the inner annular surface 26*a* of the baffle body member 26, with the body portion 16 being secured to the baffle body member 26 by means of suitable weldments 30 or any other suitable means. It is preferred that positioning of the diffuser element E be such that it is adjacent the inlet end 14*a* of the muffler housing 14 and also adjacent the inlet end 26*c* of baffle body member 26 while further being in longitudinal alignment with longitudinal axis of the baffle body member 26. Preferably, the baffle body member 26 is further formed having a plurality of slots 26*e* formed substantially perpendicular to the longitudinal axis of the baffle B. Preferably adjacent each slot 26*e*, a louver is formed in the baffle body member 26 such as louver 26*f*. Preferably, the louvers 26*f* extend inwardly into the bore of the baffle body member 26 in a cup-like configuration and are directed toward receiving gaseous flow from the inlet end 26*c* of the baffle body member 26. As best seen in the radial cross-sectional view of FIG. 4, it is preferred that the baffle body member 26 be formed having 6 of the louvers 26*f* being formed at substantially each radial cross-section along the length of the baffle body member to enhance noise diffusion as discussed more fully hereinbelow. Thus, the substantially equal spacing at each radial cross-section comprehends that the centerline louver spacing 27 (FIG. 4) between adjacent louvers is approximately every 60° at each radial cross-section. Preferably, the louvers are formed along substantially the entire length of the baffle body member 26 between the inlet and exit ends 26*c*, 26*d*.

The muffler diffuser D of the present invention further includes insulation means I for absorbing noise from the noisy gaseous exhaust with the insulation means I preferably being with the muffler M and wrapped about the baffle body member 26 for enhancing noise reduction and sound control. The insulation means I may include suitable insulation 32 which, by way of example may include fiberglass-type insulation such as that manufactured by Owens-Corning and known under the designation SR26, having 1000° F. heat resistance and having qualities desirable for absorbing sound. Typically, the insulation 32 is such that it is of a greater thickness than the distance between the outer annular surface 26*b* of baffle body member 26 and inner surface 14*d* of muffler housing 14 and as a consequence, the somewhat loosely manufactured insulation 32 is thus compressed between the baffle B and muffler housing 14 during the manufacturing process. As such, the incoming exhaust gases from the power plant flow through the exhaust pipe 10 in the direction of arrow 12 and are directed into the baffle B where the noisy, gaseous discharge is split by means of the openings O formed in the diffuser element E. The openings 22 direct the sound waves and gas therewith towards the louvers 26*f* in the direction of arrows 34, with the sound waves being directed towards the louvers 26*f* through slots 26 thereinto the insulation means I for sound absorption thereof. It is preferred that the central opening 20 be of a diameter greater than the openings 22 which prevents the buildup of back pressure in the exhaust pipe 10 of the power plant due to the flow restriction caused by the diffuser element E. For example, prior art devices result in the back pressure approaching 20 psi, yet while using the muffler diffuser D of the present invention, back pressures of only approximately 4 psi have been accounted for, thus indicating much improved reduction in back pressure to improve overall power plant performance. As such, the sound waves are thus directed radially outwardly through the slots 26*e* and louvers 26*f* into the insulation 32 for improved absorption thereof to help reduce the decible level of the gaseous exhaust departing from the muffler M in the direction of arrow 15, thereinto the tail pipe 28. As a consequence, the overall noise level of the gaseous discharge results in the reduction in decible level while also reducing the back pressure on power plant components.

Thus, the muffler diffuser D of the present invention provides a new and improved device for reducing noise and back pressure from gaseous exhaust streams from power plants of many types, yet being economical and inexpensive to manufacture.

The foregoing disclosure and description of the invention are illustrative and explanatory thereof, and various changes in the size, shape and materials, as well as in the details of the illustrated construction, may be made without departing from the spirit of the invention.

I claim:

1. A muffler diffuser adapted to be used with a muffler having an inlet end for receiving a noisy, gaseous exhaust comprising:

a diffuser element mountable within the muffler adjacent the inlet end;

said diffuser element having a body portion and a diffuser portion; said body portion being substantially of a tubular configuration and adapted to be longitudinally mounted and aligned with the longitudinal axis of the muffler;

said diffuser portion being of a substantially truncated conical configuration and adapted to be longitudinally aligned with the longitudinal axis of said body portion, with the greatest diameter of said diffuser portion adjacent the inlet end of the muffler and the smallest diameter of said diffuser portion extending downstream towards the exit end of the muffler;

said diffuser portion formed having a plurality of openings for directing the noisy, gaseous exhaust into the muffler;

a baffle body member mountable within the muffler, said baffle body member having a substantially tubular body member and adapted to be aligned with the longitudinal axis of the muffler;

said baffle body member having a plurality of louvers circumferentially disposed along the length of said baffle body member;

said louvers extending inwardly into the bore of said baffle body member towards the inlet end of the muffler so as to divert the noisy, gaseous exhaust to enhance noise diffusion; and, said diffuser portion is mounted within said baffle body member in longitudinal alignment therewith.

2. The muffler diffuser of claim 1, wherein: said diffuser portion includes a central opening for reducing back pressure caused by the noisy, gaseous exhaust.

3. The muffler diffuser of claim 1, wherein: said openings are radially disposed equidistance about said diffuser portion.

4. The muffler diffuser of claim 3, wherein: said diffuser portion is formed having eight of said openings.

5. The muffler diffuser of claim 1, wherein:

said baffle body member is formed having a plurality of slots formed substantially perpendicular to the longitudinal axis of said baffle.

6. The muffler diffuser of claim 1, wherein:

said baffle body member is formed having six of said louvers at substantially each radial cross section along the length of said baffle body member for enhanced noise reduction.

7. The muffler diffuser of claim 6, further including:

insulation means for absorbing noise from the noisy, gaseous exhaust, said insulation means with the muffler and wrapped about said baffle body member for enhanced noise reduction.

* * * * *